US008100183B2

(12) United States Patent
Mestemacher et al.

(10) Patent No.: US 8,100,183 B2
(45) Date of Patent: Jan. 24, 2012

(54) REINFORCED POLYMERIC SIPHON TUBES

(75) Inventors: Steven A. Mestemacher, Parkersburg, WV (US); Robert B. Fish, Jr., Parkersburg, WV (US); Heinrich F. Maurer, Horb (DE); Adam J. Van Der Lelij, Vesenaz (CH)

(73) Assignee: E.I. du Pont de Nemours and Company, Wilmington, DE (US)

( * ) Notice: Subject to any disclaimer, the term of this patent is extended or adjusted under 35 U.S.C. 154(b) by 44 days.

(21) Appl. No.: 12/441,720

(22) PCT Filed: Sep. 19, 2007

(86) PCT No.: PCT/US2007/020337

§ 371 (c)(1), (2), (4) Date: Mar. 18, 2009

(87) PCT Pub. No.: WO2008/051341

PCT Pub. Date: May 2, 2008

(65) Prior Publication Data

US 2009/0236098 A1 Sep. 24, 2009

Related U.S. Application Data

(60) Provisional application No. 60/854,980, filed on Oct. 27, 2006.

(51) Int. Cl.
*E21B 43/00* (2006.01)
*E21B 17/20* (2006.01)
*F16L 11/08* (2006.01)

(52) U.S. Cl. ..... 166/369; 166/242.2; 138/129; 138/130

(58) Field of Classification Search ..... 166/369, 166/242.2; 138/129, 130
See application file for complete search history.

(56) References Cited

U.S. PATENT DOCUMENTS

| | | | | | |
|---|---|---|---|---|---|
| RE35,081 | E * | 11/1995 | Quigley | ..... | 428/36.2 |
| 5,921,285 | A * | 7/1999 | Quigley et al. | ..... | 138/125 |
| 6,016,845 | A * | 1/2000 | Quigley et al. | ..... | 138/125 |
| 6,148,866 | A * | 11/2000 | Quigley et al. | ..... | 138/125 |
| 6,286,558 | B1 * | 9/2001 | Quigley et al. | ..... | 138/125 |
| 6,604,550 | B2 * | 8/2003 | Quigley et al. | ..... | 138/125 |
| 6,857,452 | B2 * | 2/2005 | Quigley et al. | ..... | 138/125 |
| 6,889,716 | B2 * | 5/2005 | Lundberg et al. | ..... | 138/130 |
| 6,978,843 | B2 * | 12/2005 | Gleim et al. | ..... | 166/384 |
| 7,281,547 | B2 * | 10/2007 | Cleveland et al. | ..... | 138/137 |
| 7,285,333 | B2 * | 10/2007 | Wideman et al. | ..... | 428/451 |
| 7,523,765 | B2 * | 4/2009 | Quigley et al. | ..... | 138/129 |
| 7,647,948 | B2 * | 1/2010 | Quigley et al. | ..... | 138/125 |
| 7,748,412 | B2 * | 7/2010 | Mennig et al. | ..... | 138/124 |
| 2002/0185188 | A1 * | 12/2002 | Quigley et al. | ..... | 138/137 |
| 2004/0035584 | A1 * | 2/2004 | Gleim et al. | ..... | 166/369 |
| 2004/0144440 | A1 * | 7/2004 | Lundberg et al. | ..... | 138/130 |
| 2005/0170118 | A1 * | 8/2005 | Cleveland et al. | ..... | 428/36.91 |
| 2005/0189029 | A1 * | 9/2005 | Quigley et al. | ..... | 138/125 |
| 2007/0125439 | A1 * | 6/2007 | Quigley et al. | ..... | 138/137 |
| 2010/0101675 | A1 * | 4/2010 | Do et al. | ..... | 138/130 |
| 2010/0263761 | A1 * | 10/2010 | Niccolls et al. | ..... | 138/146 |

OTHER PUBLICATIONS http://www.merriam-webster.com/dictionary/embed, "embed", undated, 3 pages.*

* cited by examiner

*Primary Examiner* — Jennifer H Gay

(57) ABSTRACT

A siphon tube having a polymeric material into which at least one continuous reinforcing agent is embedded, and wherein the at least one reinforcing agent runs substantially the length of the siphon tube. The polymer material can be one or more polymers selected from one or more high density polyethylenes, one or more polyamides, and one or more fluoropolymers.

6 Claims, 1 Drawing Sheet

REINFORCED POLYMERIC SIPHON TUBES

CROSS REFERENCE TO RELATED APPLICATIONS

This application claims the benefit of U.S. Provisional Application No. 60/854,980, filed Oct. 27, 2006.

FIELD OF THE INVENTION

The present invention relates to polymeric siphon tubes comprising at least one continuous reinforcing agent that runs substantially the length of the tube.

BACKGROUND OF THE INVENTION

Siphon tubes (also known as siphon strings or velocity tubes) are pipes having a relatively small diameter that are placed in natural gas wells to provide for removal of liquids (such as water) that might otherwise collect at the bottom of a well and thus impede the flow of gas from the well. Siphon tubes may be made from metal or polymeric materials, but it is desirable to use siphon tubes made from polymeric materials, as these can be formed into single tubes and can be spoolable, which facilitates transport, storage, and installation of the tubes. Metal siphon tubes also tend to be heavier and bulkier than their polymeric counterparts. Additionally, since many of the chemicals that exist naturally in wells or are typically used in well treatment are corrosive, it is often necessary that metal siphon tubes be made from expensive steel alloys. Metal siphon tubes also tend to have a rougher inner surface than polymeric tubes having the same inner diameter, which can impede fluid flow through the tubes.

Despite their advantages, current polymeric siphon tubes, which are typically made from high density polyethylene, generally can be used to a maximum depth of about 500 to 550 meters as pipes made from these materials lack the strength to support themselves at greater depths. Current polymeric siphon tubes have a tendency to creep to a substantial degree, which leads to constant increases in the length of the tube under its own weight as it hangs from the top of the well. Accurate positioning of the siphon tube in the well is important for proper operation, as a tube that is too short will not reach the liquids that accumulate at the bottom of the well and a tube that is too long can become wedged into the walls or bottom of the well or fill with mud or slit from earth at the bottom of the well, which can lead to partial or full blockage. Therefore, it would be desirable to obtain a polymeric siphon tube that has little or no creep and that can be used at depths greater than 500-550 meters when needed.

SUMMARY OF THE INVENTION

There is disclosed and claimed herein A siphon tube comprising a polymeric material into which at least one continuous reinforcing agent is embedded and wherein the at least one reinforcing agent runs substantially the length of the siphon tube. Further disclosed and claimed herein is a method of removing liquids from a natural gas well, comprising the steps of introducing into the well a siphon tube comprising a polymeric material into which at least one continuous reinforcing agent is embedded and wherein the at least one reinforcing agent runs substantially the length of the siphon tube and drawing the liquids out of the well and to the surface through the siphon tube.

DETAILED DESCRIPTION OF THE INVENTION

The siphon tubes of the present invention are polymeric tubes having a circular or roughly circular cross section that are reinforced by one or more continuous reinforcing agents that are imbedded in the walls of the tubes and run substantially the length of the tube. The reinforcing agents are selected and used such that they support the tube and prevent significant elongation of the tube while in use.

Figure 1A:
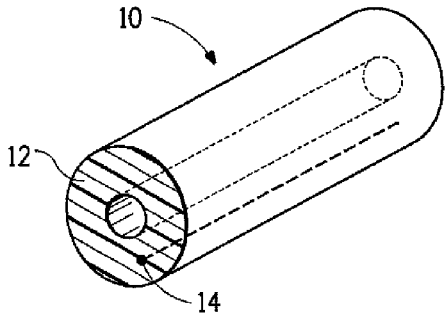
FIGS. 1A and 1B illustrate end and side views of a polymeric siphon tube (10) having one continuous reinforcing agent.
Figure 1B:
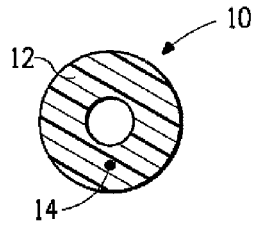

FIGS. 1A and 1 B illustrate end and side views of a polymeric siphon tube (10) including a polymeric material (12) into which one continuous reinforcing agent (14) is embedded that runs the length of the tube.

By "substantially" is meant that the reinforcing agent may run the entire length of the tube or may not run entirely to the length of one or both ends of the tube, and unreinforced sections may exist in the tube. When such unreinforced segments are present, it is preferred that they be present in portions (in particular at the end) of the tube that are close to the bottom of the well. More reinforcement can be needed in the portions of the tube that are closest to the top of the well because there the tube is supporting a significant portion of the weight of the tube and thus may require a greater degree of reinforcement, while portions of the tube close to the bottom of the well support a lesser portion of the weight of the tube and may require a lesser degree of or no reinforcement. Similarly, the reinforcing agents may be stronger in portions of the tube that are used closer to the top of the well or more agents may be present in such portions.

The tubes may optionally comprise two or more layers of polymer or one or more layers comprising a different material such as metal.

The siphon tube may contain a single reinforcing agent. It may also contain two or more reinforcing agents. When a single reinforcing agent is present the tube will have a preferred bending direction that allows it to be more easily coiled for transport and storage. When two reinforcing agents are present, it is preferred that they be positioned opposite or roughly opposite each other in the wall of the tube for ease of bending the tube. When more than two reinforcing agents are present, they may be spaced within the tube wall at approximately equal intervals. One or more clusters of two or more reinforcing agents closely positioned relative to or in physical contact with each other in the tube wall may also be used. Alternatively, more than two reinforcing agents may be used that are more widely spaced. When more than two reinforcing agents are used, it is preferred that they be positioned such that they form two clusters within the wall of the tube wherein each cluster is contained within an arc of the circumference of the cross-section of the tube that is no greater than about 30° and that the centers of each arc are at points approximately 180° from each other along the circumference.

Figure 2A:
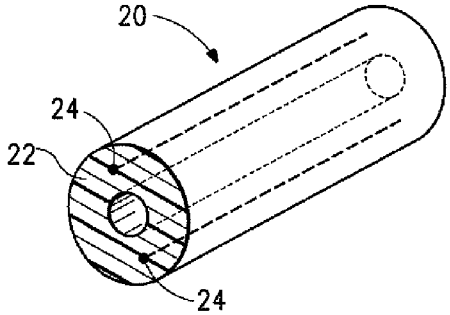
FIGS. 2A and 2B illustrate end and side views of a polymeric siphon tube (20) having two continuous reinforcing agents.
Figure 2B:
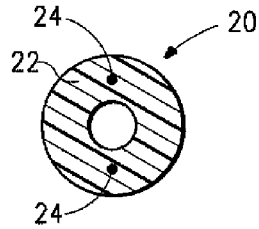

FIGS. 2A and 2B illustrate end and side views of a polymeric siphon tube (20) including a polymeric material (22) into which two continuous reinforcing agents (24) are embedded that run the length of the tube such that they are situated opposite or roughly opposite each other and are parallel or roughly parallel to each other.

Figure 3A:
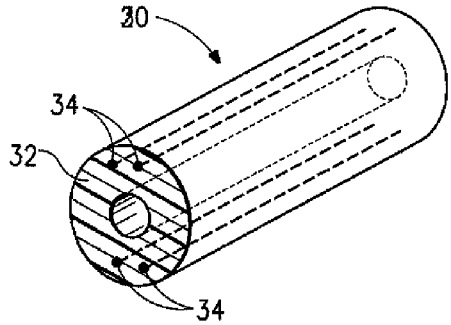
FIGS. 3A and 3B illustrate end and side views of a polymeric siphon tube (30) including more than two reinforcing agents (34) positioned such to form two clusters.
Figure 3B:
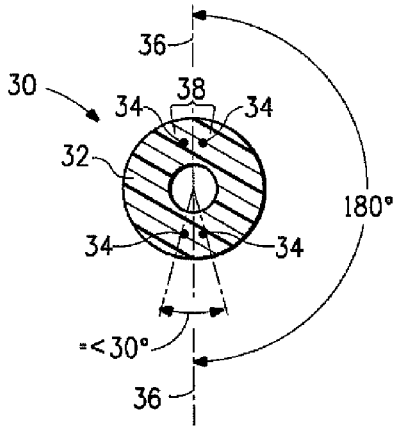

FIGS. 3A and 3B illustrate end and side views of a polymeric siphon tube (30) including a polymeric material (32) wherein more than two reinforcing agents (34) are present and are positioned such that they form two clusters (38) wherein each cluster is contained within an arc of the circumference of the cross-section of the tube that is no greater than about than about 30° and that are at points approximately 180° from each other along the circumference.

The reinforcing agents may take a wide variety of forms and may be made one or more materials. It is preferable that the material and size of a reinforcing agent be chosen such that it has a breaking strength sufficient to support the siphon tube in the well. It is also preferable that the reinforcing agent have a melting point sufficiently high that reorientation or melting does not occur during processing.

Preferred materials include, but are not limited to, fibers and metals. The fibers may be in the form of a monofilament or a multifilament. Preferred fibers include, but are not limited to, those made from high modulus materials such as aramid fibers (including KEVLAR® fibers), fiberglass, and polyesters. Polyamides and natural fibers such as cotton may be used. Metal reinforcing agents such as wires may also be used.

The reinforcing agents may take on any suitable shape. Their cross sections may be round or roughly round, elliptical, flat or nearly flat, irregularly shaped, or the like. Their shapes may vary along the length of the reinforcing agent. Suitable reinforcing agents could include extruded polymeric straps or metal strips. Oriented polyamide straps useful in the siphon tubes of the present invention are available commercially from Dymetrol Co., Inc., Wilmington, Del.

The surface of the reinforcing agent may be treated to provide better adhesion to the polymer of the siphon tube. As will be understood by those skilled in the art, the nature of the treatment will depend on the properties of the reinforcing agent and the polymer. Polymers containing functional groups derived from maleic anhydride (such as those grafted with or polymerized with maleic anhydride, maleic acid, fumaric acid, or the like) may be used to promote adhesion between polyamides and metal surfaces. An example of such a material is FUSABOND® N MF521D, which is available commercially from E.I. du Pont de Nemours and Co., Wilmington, Del. The polymeric material from which the tubes are made may be melt blended with one or more additional material that enhance adhesion. Suitable additional materials may include the foregoing polymers containing functional groups derived from maleic anhydride.

Other suitable methods of promoting adhesion include corona discharge treatment and physical roughening of the reinforcing agent. The reinforcing agent may be crimped or have barbs or other protrusions.

The tubes may be made from any suitable polymeric material, including, but not limited to, polyolefins such as high density polyethylene, polyamides, and fluoropolymers. As will be understood by one skilled in the art, the polymeric materials may be chosen in view of the conditions in the well, which may include the presence of corrosive or other reactive substances and the temperatures experienced by the siphon tube within the well. The polymeric materials may be in the form of melt-blended compositions containing other components such as, but not limited to, stabilizers, processing aids, plasticizers, impact modifiers, and colorants such as carbon black.

The siphon tubes may be made using any method known the art. For example, the polymeric material may be melted in an extruder and the molten material passed through an annular die while one or more reinforcing agents are introduced into or onto the molten polymeric material before it is quenched. After it has cooled, the tube may be moved using a puller through a forming box and toward take-up and storage equipment. For example, in an embodiment where two reinforcing agents are used spaced positioned opposite or roughly opposite each other in the wall of the tube, the reinforcing agents could be introduced from a bobbin feeding into the polymer melt before it exits the die. The movement of the formed tube through the forming box may pull fresh reinforcing agent from the bobbin.

Alternatively, a tube core may be extruded, one or more reinforcing agents introduced to the outer surface of the tube core, and a second layer extruded over the surface of the core layer.

The siphon tubes of the present invention may be used to transport liquids (including water) and other materials from the interior, and particularly, the bottom of wells such as natural gas wells.

EXAMPLES

Comparative Example 1

A siphon tube is extruded from PE3408 high density polyethylene using standard pipe extrusion techniques. The tube has a nominal outside diameter of 1.25 inches and a nominal inside diameter of 0.70 inches. The tube may be bent in any direction with approximately equal ease. The tube is hung in a natural gas well about 600 meters deep. The temperatures within the well are within the range of about 30 to 40° C. and after being installed the tube cannot support its own weight.

Comparative Example 2

The siphon tube of Comparative Example 1 is hung in a natural gas well about 500 meters deep. The temperatures within the well are within the range of about 30 to 40° C. The tube is able to support its own weight but high degrees of creep are observed and after two years of use, the tube has elongated by about 9 meters.

Example 1

A siphon tube is extruded from high density polyethylene. During the extrusion process, four metal wire reinforcing agents are placed at 90° intervals around the circumference of the tube wall. The tube is stiffer than the tubes of Comparative Examples 1 and 2. The tube is hung in a natural gas well 600 meters deep. The temperatures within the well are within the range of about 30 to 40° C. and after being installed the tube does support its own weight. After one year of use, the tube shows minimal creep and is successfully removed from the well and recoiled for further possible use.

Example 2

A siphon tube is extruded from high density polyethylene. During the extrusion process, two metal wire reinforcing agents are placed 180° apart around the circumference of the tube wall. The tube is most easily bent in the two directions corresponding to the positions along the circumference 90° from each of the wire reinforcing agents. The tube is hung in a natural gas well 600 meters deep. The temperatures within the well are within the range of about 30 to 40° C. and after being installed the tube does support its own weight. After one year of use, the tube show minimal creep and is successfully removed from the well and recoiled for further possible use.

What is claimed is:

1. An extruded siphon tube consisting essentially of an extruded polymeric material and at least two continuous reinforcing agents selected from the group consisting of monofilament fiber, multifilament fiber, and metal wire; embedded therein; and wherein the at least two reinforcing agents run substantially the length of the siphon tube and are positioned such that they form two clusters wherein each cluster is contained within an arc of the circumference of the cross-section of the tube that is no greater than about than about 30° and that the centers of each arc are at points approximately 180° from each other along the circumference.

2. The siphon tube of claim 1, wherein the extruded polymeric material comprises one or more polymers selected from the group consisting of high density polyethylenes, polyamides, and fluoropolymers.

3. The tube of claim 1, wherein the at least two continuous reinforcing agents are situated opposite or roughly opposite each other, and are parallel or roughly parallel to each other.

4. The tube of claim 1, wherein a surface of at least one of the reinforcing agents has been treated to promote adhesion between the surface and the polymeric material.

5. The tube of claim 4, wherein the surface of at least one of the reinforcing agents has been treated by at least one process selected from the group consisting of corona discharge and physical roughening.

6. A method of removing liquids from a natural gas well, comprising the steps of introducing into the well the extruded siphon tube of claim 1, and drawing the liquids out of the well and to the surface through the extruded siphon tube.

* * * * *